US011391490B2

(12) United States Patent
Knoblett et al.

(10) Patent No.: US 11,391,490 B2
(45) Date of Patent: Jul. 19, 2022

(54) OFFSET MOUNTING BRACKET FOR A WATER HEATER

(71) Applicant: RINNAI AMERICA CORPORATION, Peachtree City, GA (US)

(72) Inventors: Michael Knoblett, Peachtree City, GA (US); Ansley Houston, Peachtree City, GA (US)

(73) Assignee: RINNAI AMERICA CORPORATION, Peachtree City, GA (US)

( * ) Notice: Subject to any disclaimer, the term of this patent is extended or adjusted under 35 U.S.C. 154(b) by 0 days.

(21) Appl. No.: 16/835,411

(22) Filed: Mar. 31, 2020

(65) Prior Publication Data

US 2020/0318858 A1 Oct. 8, 2020

Related U.S. Application Data

(60) Provisional application No. 62/830,206, filed on Apr. 5, 2019.

(51) Int. Cl.

| | |
|---|---|
| ***F24H 9/06*** | (2006.01) |
| ***F24H 9/00*** | (2022.01) |
| ***F24H 1/10*** | (2022.01) |
| *F24H 9/02* | (2006.01) |

(52) U.S. Cl.

CPC ..... *F24H 9/06* (2013.01); *F24H 1/10* (2013.01); *F24H 9/0005* (2013.01); *F24H 9/02* (2013.01)

(58) Field of Classification Search

CPC . F24H 1/10; F24H 1/122; F24H 1/125; F24H 9/0005; F24H 9/06; F24H 1/128; F24H 1/18; F24H 1/20; E04B 1/2608; E04B 1/2612

USPC ..... 248/300

See application file for complete search history.

(56) References Cited

U.S. PATENT DOCUMENTS

| | | | | |
|---|---|---|---|---|
| D842,684 | S * | 3/2019 | House | D8/354 |
| 2015/0047578 | A1* | 2/2015 | Lesage | F24H 1/182 122/14.22 |
| 2019/0093923 | A1* | 3/2019 | Bober | F24H 9/06 |

FOREIGN PATENT DOCUMENTS

| | | | |
|---|---|---|---|
| JP | 41002195 | Y1 * | 2/1966 |
| JP | 61015459 | U * | 1/1986 |
| JP | 2016095051 | A * | 5/2016 |

(Continued)

*Primary Examiner* — Edelmira Bosques
*Assistant Examiner* — Michael James Giordano
(74) *Attorney, Agent, or Firm* — Meunier Carlin & Curfman LLC

(57) ABSTRACT

An offset mounting bracket that comprises a primary member and a stabilization member can be used to mount multiple heat engines to a water storage tank. An offset mounting bracket can include a primary member, having a top surface, a bottom surface, an inner surface, and an outer surface. The offset mounting bracket can also have a stabilization member, having a top surface and a bottom surface, a supporting surface that is opposed and connected to the primary member outer surface. The offset mounting bracket can also have a connecting member. The connecting member can be configured to fasten to the top of a water storage tank. There, the offset mounting bracket, can provide a surface to mount a heat engine that otherwise would not fit onto the water storage tank structure.

16 Claims, 7 Drawing Sheets

(56) References Cited

FOREIGN PATENT DOCUMENTS

| | | | | | |
|---|---|---|---|---|---|
| JP | 2016156524 | A * | 9/2016 | | |
| WO | WO-2009098991 | A1 * | 8/2009 | ..... | F24H 9/126 |

* cited by examiner

OFFSET MOUNTING BRACKET FOR A WATER HEATER

CROSS-REFERENCE TO RELATED APPLICATIONS

This application claims the benefit of U.S. application Ser. No. 62/830,206 filed Apr. 5, 2019, the disclosure of which is expressly incorporated herein by reference.

BACKGROUND

The need for heated fluids, and in particular heated water, has long been recognized. Conventionally, water has been heated by heating elements, either electrically or with gas burners, while stored in a tank or reservoir. While effective, energy efficiency and water conservation using a storage tank alone can be poor. As an example, water that is stored in a hot water storage tank is maintained at a desired temperature at all times. Thus, unless the storage tank is well insulated, heat loss through radiation can occur, requiring additional input of energy to maintain the desired temperature. In effect, continual heating of the stored water in the storage tank is required.

Many of the problems with traditional hot water storage tanks have been overcome by the use of tankless water heaters. With the tankless water heater, incoming ground water passes through a component generally known as a heat exchanger and is instantaneously heated by heating elements (or gas burner) within the heat exchanger until the temperature of the water leaving the heat exchanger matches a desired temperature set by a user of the system. With such systems the heat exchanger is typically heated by a large current flow (or Gas/BTU input) which is regulated by an electronic control system. The electronic control system also typically includes a temperature selection device, such as a thermostat, by which the user of the system can select the desired temperature of the water being output from the heat exchanger.

Tankless water heaters are often installed in existing plumbing networks that utilize a water storage tank. Tankless water heaters are often retrofitted to water storage tanks to take advantage of the efficiency of a tankless water heater, while being minimally invasive into the structure of the existing plumbing network. A user who installs a tankless water heater may use a water heater rack to mount a tankless water heater near a water storage tank. Many plumbing networks are built in an environment that is designed to house a full water heater rack, which makes retrofitting a water heater rack possible. But, some plumbing networks are built in an environment that is not large enough to house a water heater rack conveniently if at all. In such applications, it may be beneficial to mount a tankless water heater directly to an existing water storage tank.

SUMMARY

A first aspect of the disclosure provides an offset mounting bracket. The offset mounting bracket comprises a primary member, having a top surface, a bottom surface, an inner surface, and an outer surface wherein the inner surface and the outer surface extend between the top surface and the bottom surface. The primary member is configured to connect to a top mount on a heat engine. The offset mounting bracket comprises a stabilization member, having a top surface and a bottom surface, a supporting surface that is opposed and connected to the primary member outer surface, and a non-supporting surface, wherein the supporting surface and the non-supporting surface extend between the top surface and the bottom surface, and the bottom surface is offset from the primary member bottom surface in a direction that is disposed away from the primary member top surface; configured to connect to a cylindrical wall of a water storage tank. The offset mounting bracket comprises a connecting member, having a connection surface, a top surface, a radial surface, and an inner surface, wherein the radial surface and the inner surface extend between the connection surface and the top surface, and wherein the radial surface is opposing and connected to the primary member inner surface and the connection surface is coplanar with the bottom side of the primary member and configured to connect to a top surface of the water storage tank.

In some implementations of the first aspect of the disclosure, the offset mounting bracket primary member, stabilization member, and the connecting member each further comprise at least one fastening hole.

In some implementations of the first aspect of the disclosure, the outer surface of the primary member and the supporting surface of the of the stabilization member are coplanar.

A second aspect of the disclosure provides a heat engine fastening system. The heat engine fastening system comprises an offset mounting bracket. The offset mounting bracket comprises a primary member, having a top surface, a bottom surface, an inner surface, and an outer surface wherein the inner surface and the outer surface extend between the top surface and the bottom surface. The offset mounting bracket comprises a stabilization member, having a top surface and a bottom surface, a supporting surface that is opposed and connected to the primary member outer surface and configured to connect to a cylindrical wall of a water storage tank, and a non-supporting surface, wherein the supporting surface and the non-supporting surface extend between the top surface and the bottom surface, and the bottom surface is offset from the primary member bottom surface in a direction that is disposed away from the primary member top surface. The offset mounting bracket comprises a connecting member, having a connection surface, a top surface, a radial surface, and an inner surface, wherein the radial surface and the inner surface extend between the connection surface and the top surface, and wherein the radial surface is opposing and connected to the primary member inner surface and the connection surface is coplanar with the bottom side of the primary member. The heat engine fastening system comprises a lower support bracket configured to connect to the cylindrical wall of the water storage tank and having a bottom surface that is configured to be coplanar with a bottom surface of the water storage tank.

In some implementations of the second aspect of the disclosure, the angle between the stabilization member supporting surface and the connecting member top surface is 90 degrees.

In some implementations of the second aspect of the disclosure, the heat engine fastening system further comprises at least one surface adaptor, comprising a curved surface adapted to conform to the cylindrical wall of the water storage tank. The heat engine fastening system comprises a flat surface adapted to be coupled to a heat engine mount.

In some implementations of the second aspect of the disclosure, the surface adaptor is configured to connect a cylindrical object to planar fastening plane.

A third aspect of the disclosure provides a hot water supply system. The hot water supply system comprises an offset mounting bracket. The offset mounting bracket comprises a primary member, having a top surface, a bottom surface, an inner surface, and an outer surface wherein the inner surface and the outer surface extend between the top surface and the bottom surface. The offset mounting bracket comprises a stabilization member, having a top surface and a bottom surface, a supporting surface that is opposed and connected to the primary member outer surface, and a non-supporting surface, wherein the supporting surface and the non-supporting surface extend between the top surface and the bottom surface, and the bottom surface is offset from the primary member bottom surface in a direction that is disposed away from the primary member top surface. The offset mounting bracket comprises a connecting member, having a connection surface, a top surface, a radial surface, and an inner surface, wherein the radial surface and the inner surface extend between the connection surface and the top surface, and wherein the radial surface is opposing and connected to the primary member inner surface and the connection surface is coplanar with the bottom side of the primary member. The hot water supply system comprises a water storage tank, having a top surface, a bottom surface, and a cylindrical wall that extends between the top surface and the bottom surface, wherein the bottom surface of the connecting member is connected to the top surface of the water storage tank, and the supporting surface of the stabilization member is connected to the cylindrical wall of the water storage tank.

In some implementations of the third aspect of the disclosure, the hot water supply system further comprises a heat engine having a top connector, and a bottom connector, wherein the top connector is connected to the primary member and the bottom connector is connected to the cylindrical wall of the water storage tank.

In some implementations of the third aspect of the disclosure, the connecting member is connected to the top surface with at least one bolt, rivet, or weld.

In some implementations of the third aspect of the disclosure the hot water supply system further comprises, a lower support bracket having a side surface configured to connect to the cylindrical wall of the water storage tank and having a bottom surface that is configured to be coplanar with a bottom surface of a water storage tank.

In some implementations of the third aspect of the disclosure, the lower support bracket, bottom surface is coplanar with the water storage tank bottom surface.

In some implementations of the third aspect of the disclosure, the angle between the side surface and the bottom surface is 90 degrees.

In some implementations of the third aspect of the disclosure, the hot water supply system further comprises, a first heat engine fastened to the cylindrical wall of the water storage tank and the primary member. The hot water supply system further comprises a second heat engine fastened to the cylindrical wall of the water storage tank.

In some implementations of the third aspect of the disclosure, the first heat engine and the second heat engine are stacked along a plane parallel to the longitudinal axis of the water storage tank.

In some implementations of the third aspect of the disclosure, the first heat engine and the second heat engine are fastened to the primary member and the water storage tank with rivets, bolts, or welds.

In some implementations of the third aspect of the disclosure, the first heat engine is fastened to the primary member directly and fastened to the water storage tank via a surface adaptor.

In some implementations of the third aspect of the disclosure, the first heat engine and the second heat engine are tankless water heaters.

A fourth aspect of the disclosure provides a hot water supply system. The hot water supply system comprises an offset mounting bracket. The offset mounting bracket comprises a primary member, having a top edge, a bottom edge, a first edge, and a second edge, wherein the first edge and the second edge extend between the top edge and the bottom edge. The offset mounting bracket comprises a plurality of structural supports each having a top side that is coplanar with the top edge of the primary member and a fastening side that is coplanar with the bottom edge of the primary member, wherein each of the plurality of structural supports are connected to the first edge and the second edge of the primary member and extend away from the primary member at an angle. The offset mounting bracket comprises a plurality of connecting members, wherein each of the connecting members connect to the fastening side of one of the plurality of structural supports, wherein each of the plurality of connecting members extends away from the first edge and the second edge of the primary member. The hot water supply system comprises a water storage tank, having a top surface, a bottom surface, and a cylindrical wall that extends between the top surface and the bottom surface, wherein the plurality of connecting members are connected to the top surface of the water storage tank.

DETAILED DESCRIPTION

Figure 1:
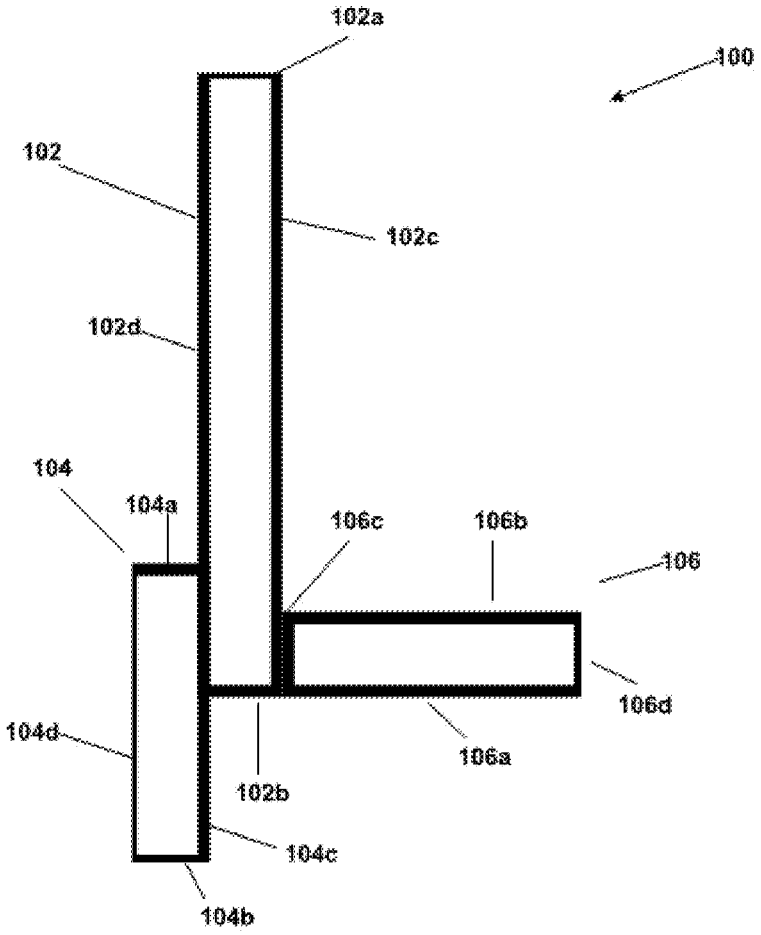
FIG. 1 illustrates a side view of an embodiment of an offset mounting bracket.

It should be understood at the outset that although illustrative implementations of one or more embodiments are illustrated below, the disclosed systems and methods may be implemented using any number of techniques, whether currently known or in existence. Like numbers represent like parts throughout the various figures, the description of which is not repeated for each figure. The disclosure should in no way be limited to the illustrative implementations, drawings, and techniques illustrated below, but may be modified within the scope of the appended claims along with their full scope of equivalents. Use of the phrase "and/or" indicates that any one or any combination of a list of options can be used. For example, "A, B, and/or C" means "A", or "B", or "C", or "A and B", or "A and C", or "B and C", or "A and B and C".

An offset mounting bracket that comprises a primary member and a stabilization member can be used to mount multiple heat engines to a water storage tank. Such heat engines can be tankless water heaters for example. Tankless water heaters are often used in pairs to promote efficient and continuous water circulation. The size of an average tankless water heater may often be too large to mount more than one on a water storage tank directly. Tankless water heaters, which are stacked vertically and parallel the longitudinal axis of the water storage tank, are often too tall to fit on a standard water storage tank.

The ability to mount a tankless water heater to a water storage tank can be beneficial in a water heating system that requires retrofit of a tankless water heater into a piping network that contains a hot water storage tank. An offset mounting bracket can be especially beneficial in situations where space around the hot water storage tank is limited and the hot water storage tank is not tall enough to accommodate directly mounting multiple tankless water heaters to the water storage tank. As such, a top connection bracket of a tankless water heater may extend above a top of the water storage tank. The offset mounting bracket may allow a user to mount a bottom bracket of the tankless water heater directly to the hot water storage tank and a top connection bracket of the tankless water heater to the mounting bracket. The mounting bracket may be mounted to one or more surfaces on the water storage tank, such as the top and sidewall surfaces. This provides a structure to support the tankless water heaters while taking minimal space in addition to the water storage tank. Such an offset mounting bracket can make it possible to accommodate retrofitting existing plumbing network applications that have significant space constraints.

When compared with a traditional water heater and water storage tank system, the above features provide for a larger capacity hot water system with redundant heating engines in a smaller footprint and overall volume of space than conventional redundant high capacity water heating systems. For example, an implementation of the hot water supply system can include a 119-gallon intelligent hot water storage system with a 15 GPM recirculation pump. The hot water supply system can include a water heating engine system with two tankless water heaters with an input less than 200,000 BTU/hr. In some implementations, the input is greater than 190,000 BTU/hr. In this exemplary implementation, the hot water system occupies a square footage of less than 16.38 square feet and a total system volume of less than 103.9 cubic feet. For example, the hot water supply system occupies a square footage of about 11.13 square feet and a total system volume of about 64.5 cubic feet. Accordingly, the hot water supply system provides for increased capacity while providing redundant heating engines in a smaller floor space than conventional systems.

FIG. 1 illustrates an offset mounting bracket 100, which includes a primary member 102, a stabilization member 104 and a connecting member 106. The mounting bracket 100 may have a rigid body where each member is rigidly connected to at least one other member. Each member may be connected to the others by welding or fastening. The primary member 102 has a top surface 102*a*, a bottom surface 102*b*, an inner surface 102*c*, and an outer surface 102*d*. The inner surface 102*c* and the outer surface 102*d* extend between the top surface 102*a* and the bottom surface 102*b*. In some implementations, the primary member 102 can have at least one fastening hole, which may pass through the inner surface 102*c* and the outer surface 102*d* (shown in FIG. 3). A heat engine such as a tankless water heater, can be fastened to the primary member using a fastener such as a bolt, a rivet, or a weld. In some implementations that include a bolt, the bolt can be inserted through the at least one fastening hole. The primary member provides an interface to connect a heat engine and can be the primary connection point for mounting a heat engine. The primary member can also be a central structural support for the offset mounting bracket 100.

The stabilization member 104, has a top surface 104*a* a bottom surface 104*b*, a supporting surface 104*c* that is opposed and connected to the primary member outer surface 102*d*, and a non-supporting surface 104*d*. The supporting surface 104*c* and the non-supporting surface 104*d* extend between the top surface 104*a* and the bottom surface 104*b*. The bottom surface 104*b* of the stabilization member 104 can be offset from the bottom surface 102*b* of the primary member 102 in a direction that is disposed away from the primary member 102 top surface 102*a*. The stabilization member 104 can be configured to rest against a cylindrical wall of a water storage tank (shown in FIG. 2). The supporting surface 104*d* can face and rest against a parallel surface, to support the structure of the offset mounting bracket 100. For example, the stabilization member 104 can rest against the cylindrical wall of the water storage tank (shown in FIG. 2). The stabilization member 104 can support the weight of the offset mounting bracket 100 and any object that is attached thereto, such as a heat engine. The stabilization member 104 can be configured such that the structure of a water storage tank, can exert a normal force against the supporting surface 104*c* and stabilize the offset mounting bracket 100 against any rotational force caused by the weight of an attached object.

The connecting member 106, has a connection surface 106*a*, a top surface 106*b*, a radial surface 106*c*, and an inner surface 106*d*. The radial surface 106*c* and the inner surface 106*d* extend between the connection surface 106*a* and the top surface 106*b*. The radial surface 106*c* is opposing and connected to the primary member 102 inner surface 102*c* and the connection surface 106*a* is coplanar with the bottom surface 102*b* of the primary member 102 and configured to connect to a top surface of the water storage tank (shown in FIG. 2). The majority of the surface area of the connection surface 106*a* of the connecting member 106 can be in contact with the top surface of the water storage tank, providing a sufficient fastening structure to secure the weight of a heat engine to the water storage tank (shown in FIG. 2). The top surface 106*b* of the connecting member can also be perpendicular to the supporting surface 104*c* of the stabilization member 104. The connection surface 106*a* can be parallel to the water storage tank top surface (shown in FIG. 2). The connecting member 106 can be configured to contain at least one fastening hole (shown in FIG. 4 and FIG. 6) that can pass through the connection surface 106*a* and the top surface 106*d*. The connecting member 106 can be connected to the water storage tank (shown in FIG. 2) using a fastener such as at least one bolt, a rivet, or a weld.

The offset mounting bracket 100 can be formed from many materials such as aluminum, steel, tin, or plastic for example. In some implementations, the primary member 102, stabilization member 104, and the connecting member 106 may be formed as separate components. Each of these separate components may be connected with welds, or fastening elements, such as rivets or bolts. The primary member 102, stabilization member 104, and the connecting member 106 may also be integrally formed. For example, the primary member 102 and the connecting member 106 may be formed from a single piece of material, which may be bent to form the separate surface planes of the primary member 102 and the connecting member 106. A joggle bend (shown in FIG. 5) may be formed in the single piece of material to form the stabilization member 104 with a plane that is displaced from a plane of the primary member 102.

Figure 2:
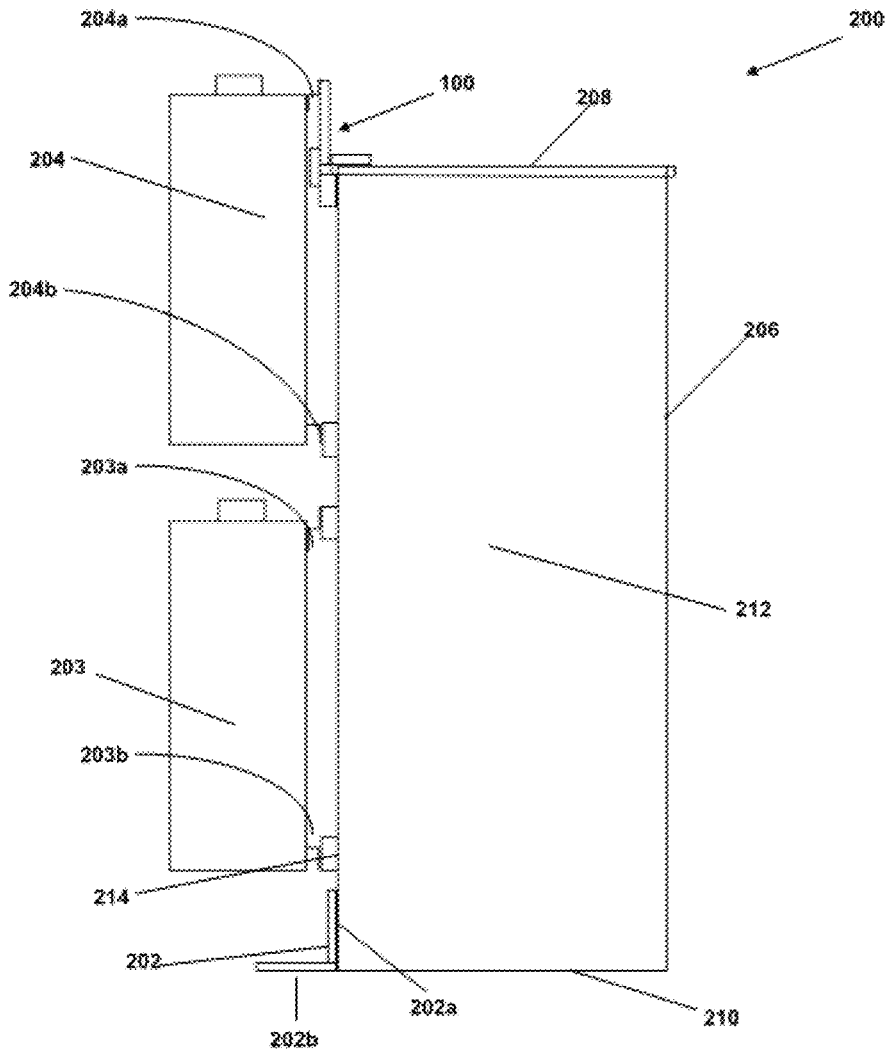
FIG. 2 illustrates a side view of an embodiment of a hot water supply system.

FIG. 2 illustrates a side view of an implementation of a hot water supply system 200. The hot water supply system 200 can have the offset mounting bracket 100, a lower support bracket 202, a first heat engine 203, a second heat engine 204, and a water storage tank 206. The water storage tank 206 can have an inner volume configured to hold a volume of water. The inner volume of the water storage tank 206 is fluidically coupled to an outlet of at least one of the heat engines 203, 204. The water storage tank 206 can have a top surface 208, a bottom surface 210, and a cylindrical wall, 212 that extends between the water storage tank 206 top surface 208 and the water storage tank 206 bottom surface 210.

The lower support bracket 202 can also be connected to the water storage tank 206 cylindrical wall 212. The lower support bracket 202 can be an L-shaped bracket. In some implementations, the lower support bracket 202 can be configured to have a side surface 202*a* that connects to the cylindrical wall 212 of the water storage tank 206. The lower support bracket 202 can also have a bottom surface 202*b*. In some implementations the bottom surface 202*b* can be coplanar with the bottom surface 210 of the water storage tank 206. The side surface 202*a* of the lower support bracket can be perpendicular to the bottom surface 202*b* of the lower support bracket 202. At least one point on the lower support bracket 202 bottom surface 202*b* can be coplanar with the bottom surface 210 of the water storage tank 206. The lower support bracket 202 can stabilize a hot water supply system 200. Specifically, when a water storage tank 206 is not filled with water, the heat engines 203, 204 may displace the hot water supply system's 200 center of gravity and cause the possibility of tipping. The lower support bracket may provide additional stabilization in the direction of the heat engines 203, 204 and mitigate the possibility of tipping the hot water supply system 200.

The at least one heat engine 203, 204 can be mounted to the water storage tank 206 via at least one offset mounting bracket 100 and at least one surface adaptor 214. In some implementations two heat engines 203, 204 can be mounted to a water storage tank 206 via three surface adaptors 214 and an offset mounting bracket 100. Each of the heat engines 203, 204 can have top mounts 203*a*, 204*a* and bottom mounts 203*b*, 204*b*, such that one of the heat engine top mounts 203*a*, and bottom mounts 203*b* can each be connected to a surface adaptor 214 respectively. A second heat engine 204 can have bottom mounts 204*b* that are connected to a surface adaptor 214, while the top mounts 204*a* can be connected to the offset mounting bracket 100 primary member 102.

Figure 3:
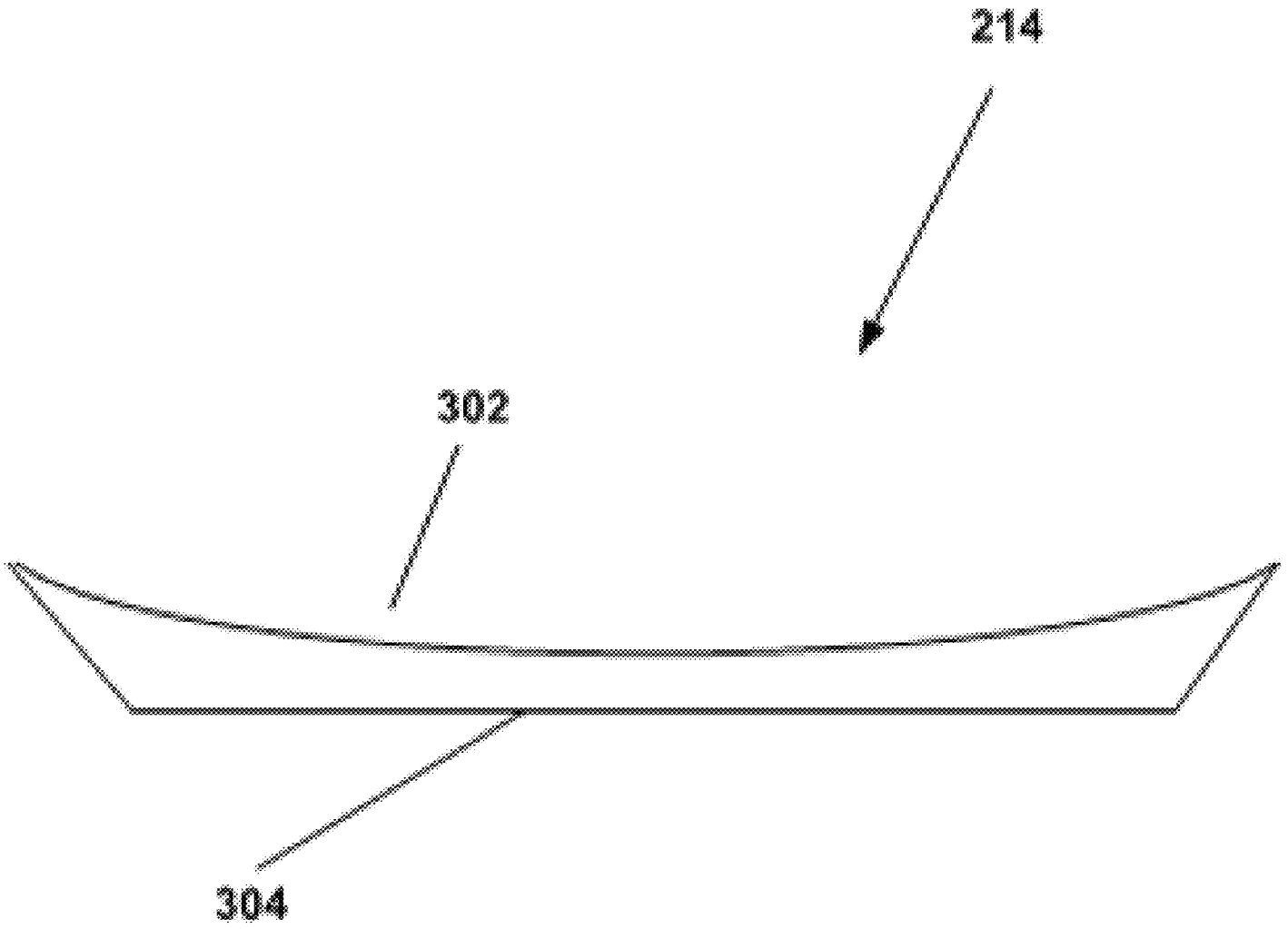
FIG. 3 illustrates a top view of a surface adaptor.

FIG. 3 illustrates an implementation of the surface adaptor 214, described above with reference to FIG. 2. The surface adaptor 214 has a planar fastening surface, which provides a surface adapted to connect to a heat engine, such as a heat engine top or bottom mount and provides an opposing curved surface which conforms to the cylindrical wall of the storage tank (shown in FIG. 2). This surface adaptor allows a heat engine (shown in FIG. 2) to connect directly to the cylindrical wall of the storage tank in situations where it is beneficial for the heat engines to be situated closely to the water storage tank and not on a separate mount (shown in FIG. 2). The surface adaptor can have a curved side 302 and a flat side 304. The curved side 302 can connect and fasten to a cylindrical wall (shown in FIG. 2). The flat side 304 can connect to a flat connecting surface such as a heat engine mount (shown in FIG. 2). The curved side 302 can have mounting holes (not shown) that connect to a cylindrical surface such as a water storage tank side wall and fasten thereto (shown in FIG. 2). The flat side 304 can also have mounting holes. The surface adaptor (shown in FIG. 2) can connect on the flat side 304 and the curved side 302 using at least one bolt rivet or weld.

Figure 4:
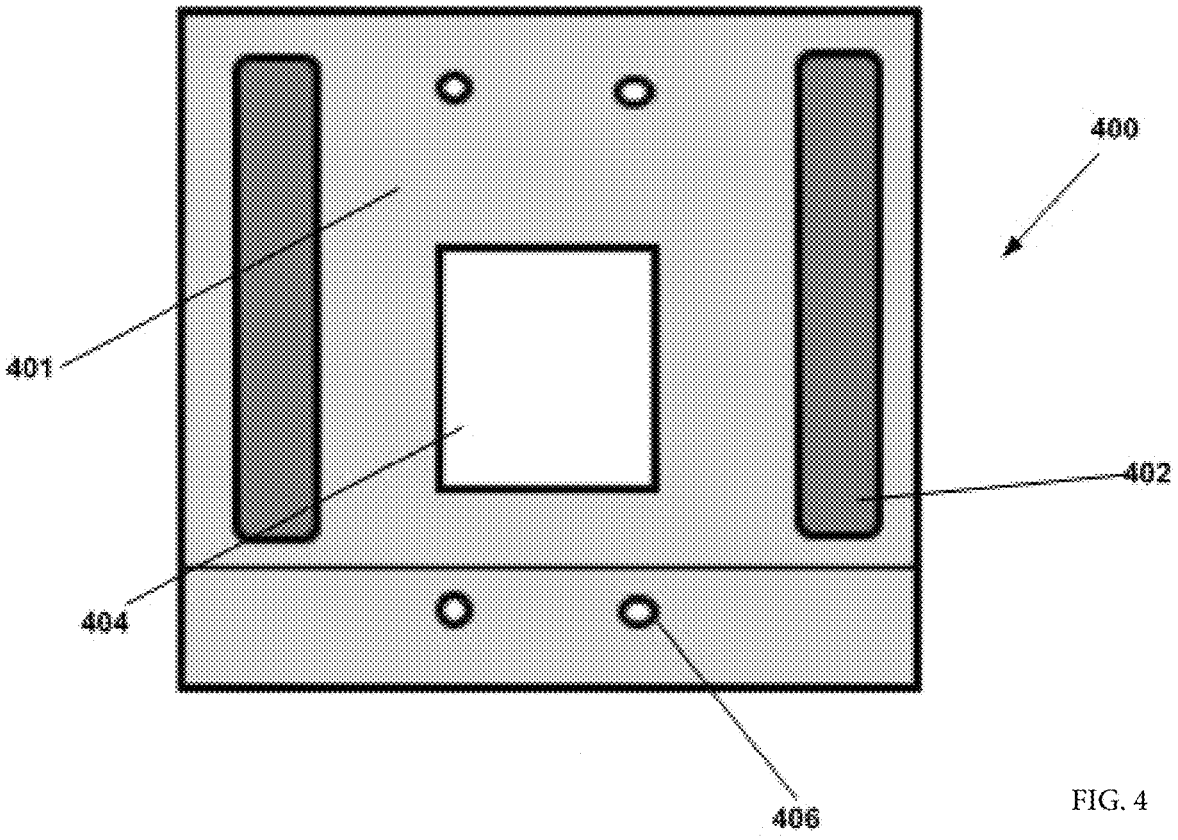
FIG. 4 illustrates a front view of an embodiment of an offset mounting bracket.
Figure 5:
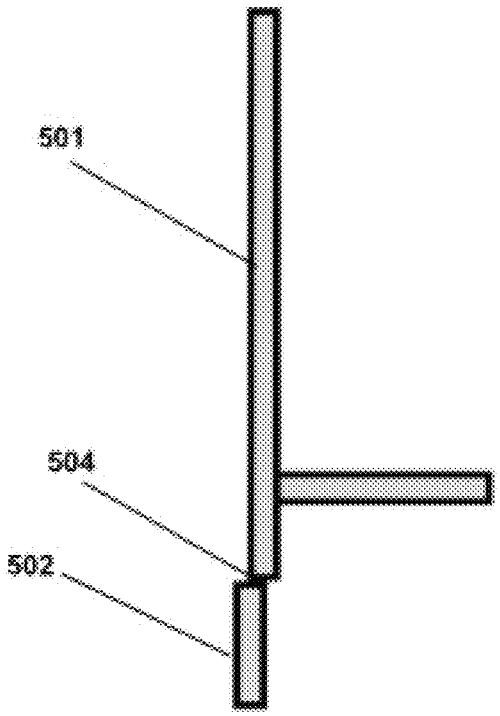
FIG. 5 illustrates a side view of an embodiment of an offset mounting bracket.
Figure 6:
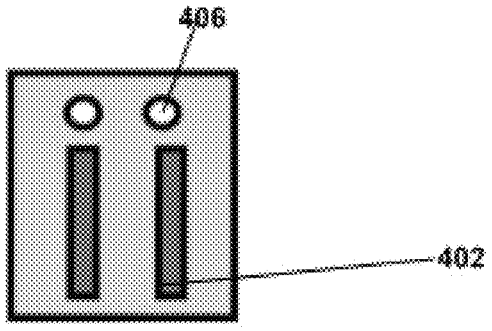
FIG. 6 illustrates a front view of an embodiment of an offset mounting bracket primary member.

FIGS. 4-6 illustrate several views of an embodiment of an offset mounting bracket 400. The offset mounting bracket 400 is substantially similar to the offset mounting bracket 100 described above. The offset mounting bracket 400 can be formed with embosses 402 that can relieve structural stress in the primary member 401 and can increase the structural rigidity of the primary member 401 which is substantially similar to the primary member 102 described above. The embosses 402 can be formed using a metal forming technique such as die pressing. In some implementations, the primary member 401 and the stabilization member 502 can be formed from a single piece of metal. The stabilization member 502 is also substantially similar to the stabilization member 104 described above. The stabilization member 502 can be offset from the primary member 401 by the joggle bend 504 as also described above. In other implementations, the stabilization member 502 can be connected to the outer surface 501 of the primary member 401. Additionally, the primary member 401 can have a cut-out 404 that saves weight and provides an additional handling surface for installation in high places such as the top surface of a water storage tank (shown in FIG. 2). In some implementations, the primary member 401 can have any number of fastening holes 406, such as four fastening holes or two fastening holes for example.

Figure 7:
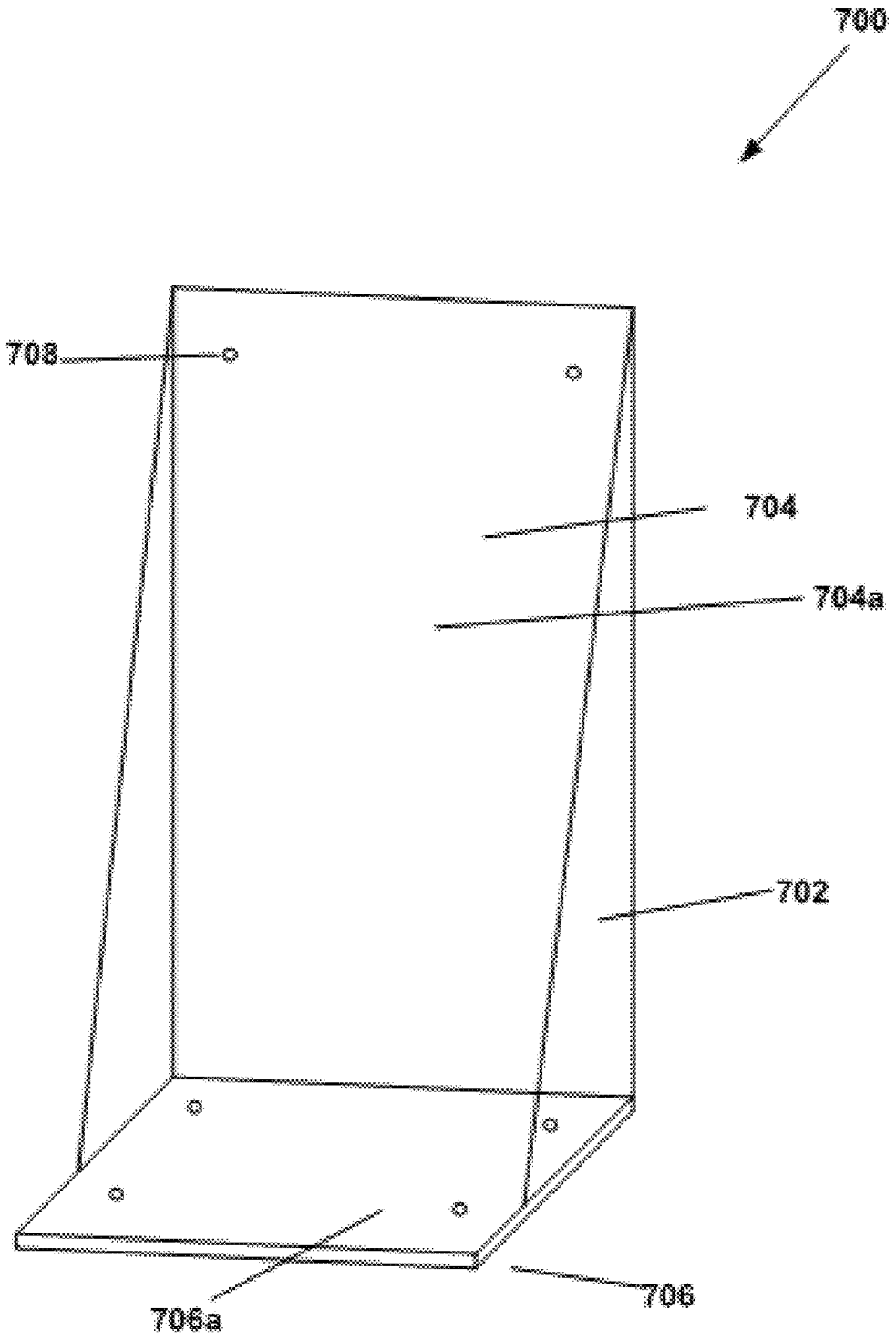
FIG. 7 illustrates a perspective view of an alternative embodiment of the offset mounting bracket.

FIG. 7 shows an implementation of an offset mounting bracket 700 which has structural supports 702. The offset mounting bracket 700 can have a primary member 704, a connecting member 706 and at least one structural support 702. The at least one structural support 702 can connect the primary member 704 inner surface 702*a* to the connecting member 706 top surface 706*a*. The primary member 704 and the connecting member 706 can have at least one fastening hole 708 that may be used to fasten a heat engine as discussed in other implementations above. The connecting member 706 can connect to a flat surface such as the top surface of a water storage tank (shown in FIG. 2). The primary member 704 can connect to a heat engine as discussed above. The primary member 702 and the connecting member 706 can connect to another surface using at least one bolt rivet or weld. The structural supports 702 may strengthen the rigidity of the offset mounting bracket 700 to hold the weight of a heat engine. This may be especially useful in implementations where the primary member 704 and the connecting member 706 are integrally formed, or formed from a light weight material, such as aluminum.

Figure 8:
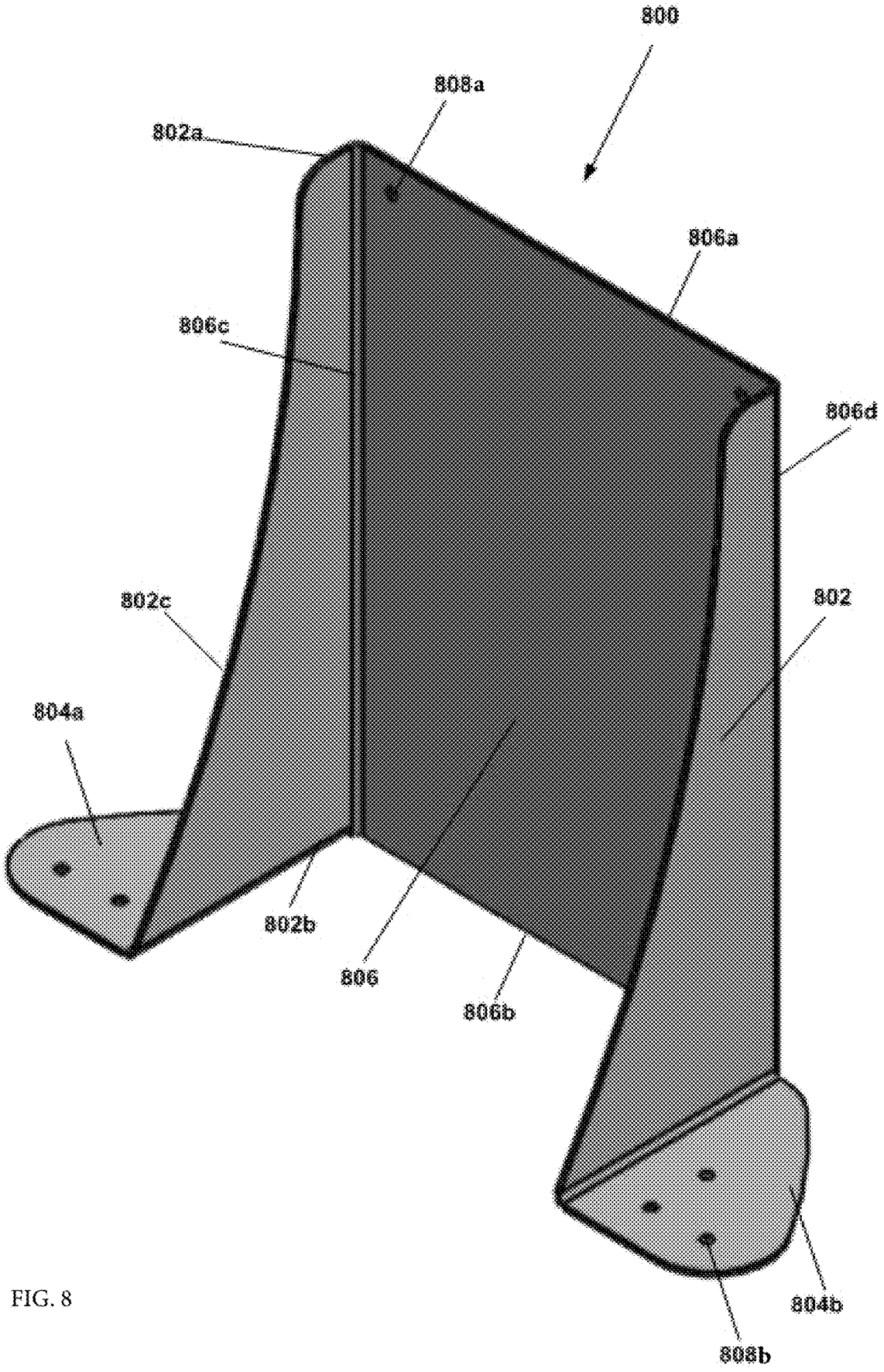
FIG. 8 illustrates a perspective view of an alternative embodiment of the offset mounting bracket.
Figure 9:
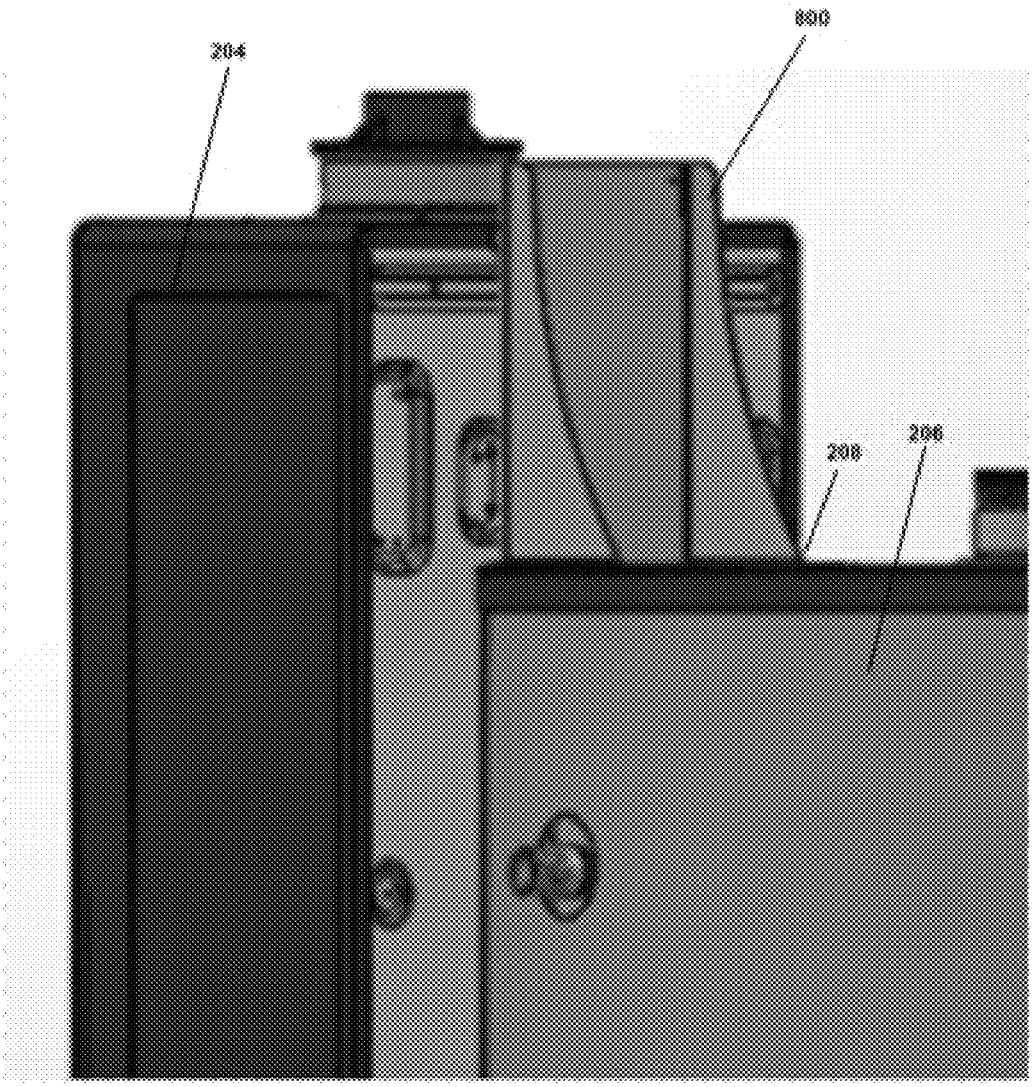
FIG. 9 illustrates a perspective view of a section of a hot water supply system.

FIGS. 8 and 9 show an implementation of an offset mounting bracket 800, which has a primary member 806, a plurality of structural supports 802 coupled along a length of the primary member, and a plurality of outer connecting members 804*a*, 804*b* coupled to the plurality of structural supports 802. The primary member 806 can have a top edge 806*a*, a bottom edge 806*b* opposite from the top edge 806*a*, a first edge 806*c* that is perpendicular to the top and bottom edges 806*a*, 806*b*, and a second edge 806*d* that is opposite from the first edge 806*c* and is also perpendicular to the top and bottom edges 806*a*, 806*b*. The primary member 806, which is substantially similar to the primary member 102, 401, 704 described above, can connect directly to a top mount on the heat engine 204, which can be a tankless water heater. Specifically, the primary member 806 comprises a plurality of fastening holes 808*a* for connecting the mounting bracket 800 to the top mount of the heat engine 204.

The primary member 806 is connected to the plurality of structural supports 802. One of the plurality of structural supports 802 can be connected along the first edge 806*c* of the primary member 806 and one of the plurality of structural supports 802 can be connected along the second edge 806*d* of the primary member 806. Therefore, each of the structural supports 802 has an edge that extends along a length of the first or second edge 806*c*, 806*d*. Each of the plurality of structural supports 802 has a top side 802*a* and a fastening side 802*b*. The top side 802*a* is coupled to the top edge 806*a* of the primary member 806. The fastening side 802*b* is coupled to the bottom edge 806*b* of the primary member 806. In some implementations, the plurality of structural supports 802 can have a curved side 802*c* that extends away from the primary member. The curved side 802*c* extends farthest away from the primary member 806 on the fastening side 802*b* and closest to the primary member 806 on the top side 802*a*. In various implementations, the curved side 802*c* may have a decay curve profile from the fastening side 802*b* to the top side 802*a*. The curved side 802*c* can allow an assembly tool to rotate with a substantial range of motion when used to fasten the primary member 806 to a surface via the fastening holes 808*a*.

In some implementations, the plurality of structural supports 802 can extend at an angle away from the primary member 806. In some implementations, the angle can be 90 degrees. In some implementations, the angle can be between 80-100 degrees. The plurality of structural supports 802, which are substantially similar to the structural supports described above in FIG. 7, can strengthen the rigidity of the offset mounting bracket 800.

Each of the plurality of structural supports 802 can connect to an outer connecting member 804*a*, 804*b* along the fastening side 802*b*. Each of the outer connecting members 804*a*, 804*b* extend in a direction away from the fastening side 802*b* of the structural supports 802 and parallel to the bottom edge 806*b* of the primary member 806. As shown, the connecting members 804*a*, 804*b* are perpendicular to both the primary member 806 and the structural supports 802. In other words, the connecting members 804*a*, 804*b* extend away from the first and second edges 806*c*, 806*d* of the primary member 806, respectively. The connecting members 804*a*, 804*b* have a rounded triangular shape with the base of the triangular shape connected along the fastening side 802*b* of the structural supports 802 and a height of the triangular shape spaced farthest away from the primary member 806.

Each of the connecting members 804*a*, 804*b*, can be configured to connect to a flat surface such as the top surface 208 of the water storage tank 206. In some implementations, the connecting members 804*a*, 804*b* have a plurality of fastening holes 808*b* therein. As shown, the fastening holes 808*b* are positioned away from the primary member 806. The connecting members 804*a*, 804*b* can be fastened to a surface using a fastener such as a bolt, rivet, or weld.

In some implementations the offset mounting bracket 800 can be integrally formed from a single piece of material. For example, the single piece of material can be bent, molded, or formed to include the primary member 806, structural supports 802, and connecting members 804*a*, 804*b*. In some implementations, the offset mounting bracket can be formed from 14-gauge steel. Rigid and formable materials, such as 14-gauge steel, can provide substantial structural rigidity for the offset mounting bracket 800 and provide structural support to sustain the weight of an attached heat engine such as a tankless water heater.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A hot water supply system comprising:

an offset mounting bracket comprising:

a primary member, having a top surface, a bottom surface, an inner surface, and an outer surface, and at least one connection point on the outer surface, wherein the inner surface and the outer surface extend between the top surface and the bottom surface;

a stabilization member, having a top surface and a bottom surface, a supporting surface that is opposed and connected to the primary member outer surface, and a non-supporting surface, wherein the supporting surface and the non-supporting surface extend between the top surface and the bottom surface, and the bottom surface is offset from the primary member bottom surface in a direction that is disposed away from the primary member top surface;

a connecting member, having a connection surface, a top surface, a radial surface, and an inner surface, wherein the radial surface and the inner surface extend between the connection surface and the top surface, and wherein the radial surface is opposing and connected to the primary member inner surface and the connection surface is coplanar with the bottom side of the primary member;

a water storage tank, having a top surface, a bottom surface, and a cylindrical wall that extends between the top surface and the bottom surface, wherein the bottom surface of the connecting member is connected to the top surface of the water storage tank, and the supporting surface of the stabilization member is connected to the cylindrical wall of the water storage tank, wherein the at least one connection point on the outer surface of the primary member is spaced apart from the top surface of the water storage tank in a direction away from the bottom surface of the water storage tank;

a first heat engine having a top connector, and a bottom connector, wherein the top connector is connected to the primary member and the bottom connector is connected to the cylindrical wall of the water storage tank; and a second heat engine having a top connector, and a bottom connector, wherein the top connector and the bottom connector are connected to the cylindrical wall of the water storage tank.

2. The hot water supply system of claim 1 further comprising, a lower support bracket having a side surface configured to connect to the cylindrical wall of the water storage tank and having a bottom surface that is configured to be coplanar with a bottom surface of a water storage tank.

3. The hot water supply system of claim 1, wherein the first heat engine and the second heat engine are fastened to the primary member and the water storage tank with rivets, bolts, or welds.

4. A hot water supply system comprising:

an offset mounting bracket comprising:

a primary member, having a top edge, a bottom edge, a first edge, and a second edge, and at least one connection point disposed between the top edge and the bottom edge, wherein the first edge and the second edge extend between the top edge and the bottom edge;

a plurality of structural supports each having a top side that is coplanar with the top edge of the primary member and a fastening side that is coplanar with the bottom edge of the primary member, wherein each of the plurality of structural supports are connected to the first edge and the second edge of the primary member and extend away from the primary member at an angle;

a plurality of connecting members, wherein each of the connecting members connect to the fastening side of one of the plurality of structural supports, wherein each of the plurality of connecting members extends away from the first edge and the second edge of the primary member; and a water storage tank, having a top surface, a bottom surface, and a cylindrical wall that extends between the top surface and the bottom surface, wherein the plurality of connecting members are connected to the top surface of the water storage tank, wherein the at least one connection point is configured to accept a fastener in a direction substantially perpendicular to the top surface of the water storage tank, a first heat engine fastened to the cylindrical wall of the water storage tank and the primary member, and a second heat engine fastened to the cylindrical wall of the water storage tank.

5. The hot water supply system of claim 4 wherein the primary member, the structural supports, and the connecting members each further comprise at least one fastening hole.

6. The hot water supply system of claim 4, wherein the outer surface of the primary member and a supporting surface of the of the structural supports are coplanar.

7. The hot water supply system of claim 4, further comprising at least one surface adaptor, comprising a curved surface adapted to conform to the cylindrical wall of the water storage tank and a flat surface adapted to be coupled to a heat engine mount.

8. The hot water supply system of claim 7, wherein the surface adaptor is configured to connect a cylindrical object to a planar fastening plane.

9. A hot water supply system comprising:

an offset mounting bracket comprising:

a primary member, having a top edge, a bottom edge, a first edge, and a second edge, and at least one connection point disposed between the top edge and the bottom edge, wherein the first edge and the second edge extend between the top edge and the bottom edge;

a plurality of structural supports each having a top side that is coplanar with the top edge of the primary member and a fastening side that is coplanar with the bottom edge of the primary member, wherein each of the plurality of structural supports are connected to the first edge and the second edge of the primary member and extend away from the primary member at an angle;

a plurality of connecting members, wherein each of the connecting members connect to the fastening side of one of the plurality of structural supports, wherein each of the plurality of connecting members extends away from the first edge and the second edge of the primary member;

a water storage tank, having a top surface, a bottom surface, and a cylindrical wall that extends between the top surface and the bottom surface, wherein the plurality of connecting members are connected to the top surface of the water storage tank, wherein the at least one connection point is configured to accept a fastener in a direction substantially perpendicular to the top of the water storage tank, at least one surface adaptor, comprising a curved surface adapted to conform to the cylindrical wall of the water storage tank and a flat surface adapted to be coupled to a heat engine mount; and a heat engine having a top connector, and a bottom connector, wherein the top connector is connected to the primary member and the bottom connector is connected to the cylindrical wall of the water storage tank.

10. The hot water supply system of claim 7, wherein the connecting members is connected to the top surface with at least one bolt, rivet, or weld.

11. The hot water supply system of claim 7, further comprising, a lower support bracket having a side surface configured to connect to the cylindrical wall of the water storage tank and having a bottom surface that is configured to be coplanar with the bottom surface of the water storage tank.

12. The hot water supply system of claim 11 wherein the angle between the side surface and the bottom surface is 90 degrees.

13. The hot water supply system of claim 7, wherein the first heat engine and the second heat engine are stacked along a plane parallel to the longitudinal axis of the water storage tank.

14. The hot water supply system of claim 7, wherein the first heat engine and the second heat engine are fastened to the primary member and the water storage tank with rivets, bolts, or welds.

15. The hot water supply system of claim 7, wherein the first heat engine is fastened to the primary member directly and fastened to the water storage tank via a surface adaptor.

16. The hot water supply system of claim 7, wherein the first heat engine and the second heat engine are tankless water heaters.

* * * * *